US010260764B2

(12) United States Patent
Deweerdt

(10) Patent No.: US 10,260,764 B2
(45) Date of Patent: Apr. 16, 2019

(54) DEVICE FOR GENERATING AN AIR WALL

(71) Applicant: Peter Julien Joseph Deweerdt, Erembodegem (BE)

(72) Inventor: Peter Julien Joseph Deweerdt, Erembodegem (BE)

(73) Assignee: HANDELSMAATSCHAPPIJ WILLY DEWEERDT BVBA, Sint-Ulriks-Kapelle (BE)

( * ) Notice: Subject to any disclaimer, the term of this patent is extended or adjusted under 35 U.S.C. 154(b) by 1128 days.

(21) Appl. No.: 14/139,866

(22) Filed: Dec. 23, 2013

(65) Prior Publication Data

US 2014/0179217 A1 Jun. 26, 2014

(30) Foreign Application Priority Data

Dec. 24, 2012 (BE) ..... 2012/0877

(51) Int. Cl.
*F24F 9/00* (2006.01)

(52) U.S. Cl.
CPC ..... *F24F 9/00* (2013.01); *F24F 2009/005* (2013.01)

(58) Field of Classification Search
CPC ..... F24F 9/00; F24F 2009/005
USPC ..... 454/191
See application file for complete search history.

(56) References Cited

U.S. PATENT DOCUMENTS

| | | | | |
|---|---|---|---|---|
| 3,350,994 | A | 11/1967 | Guibert | |
| 2004/0242146 | A1 | 12/2004 | Falk | |
| 2005/0197057 | A1* | 9/2005 | Rohrer | F24F 9/00 454/191 |
| 2010/0291856 | A1* | 11/2010 | Berben | F24F 9/00 454/191 |

FOREIGN PATENT DOCUMENTS

| | | | |
|---|---|---|---|
| DE | 20116802 | U1 | 4/2003 |
| EP | 1342959 | A1 | 9/2003 |
| GB | 968358 | A | 9/1964 |
| WO | 2005008141 | A1 | 1/2005 |
| WO | 20090051482 | A1 | 4/2009 |

OTHER PUBLICATIONS

EP Search Report, EP Appln. No. 13199531 (dated Feb. 28, 2014).

* cited by examiner

*Primary Examiner* — Helena Kosanovic
(74) *Attorney, Agent, or Firm* — Stein IP, LLC

(57) ABSTRACT

The invention relates to a device (1) for generating an air wall across a passage opening (100), which passage opening (100) has lateral edges and a top edge, comprising: a first and second blowing device (10, 20), arranged at the lateral edges in such a way that planar air streams are blown over the height and respective parts of the width of the passage opening (100); wherein the device (1) is provided with regulating means (13; 23) for regulating the blowing speeds of the blowing devices; and wherein the first blowing device (10) and the second blowing device (20) are provided with secondary blower slits (12; 22) which are parallel to the respective primary blower slits (11; 21), which secondary blower slits (12; 22) are connected to secondary means for drying and/or heating air to be blown.

12 Claims, 3 Drawing Sheets

DEVICE FOR GENERATING AN AIR WALL

RELATED APPLICATION

This application claims priority under 35 U.S.C. 119(b) and 37 CFR 1.55(d) to Belgium Application No. BE 2012/0877 filed Dec. 24, 2012, which is incorporated herein by reference.

The present invention relates to a device for generating an air wall in order to separate two spaces. A device of this type is known from international patent application WO 2009/051482 A1 in the name of the present applicant.

The known device blows an air wall from a blowing device at one side of the opening to be screened towards the opposite side. The air wall comprises a primary air stream which forms a rigid wall owing to the specific dimensions of the blower slit and the selected air speed, and a secondary air stream which is either generated by the device or entrained by the primary stream as a result of aerodynamic effects. Suitable conditioning of the air in the primary and the secondary air stream makes it possible to prevent the formation of mist and/or ice at the interfaces between the successive layers of air.

However, the known device has a limited range. Until now, use has been made of a suction device arranged at the opposite side of the blowing device in order to achieve larger ranges, which makes it possible to maintain the planar and layered characteristics of the air wall over a greater distance.

It is an object of embodiments of the present invention to provide a device of the type described above which exhibits a greater range.

This object is achieved by the device according to Claim 1 and the method according to Claim 6.

According to a first aspect of the invention, a device is provided for generating an air wall across a passage opening between a first space and a second space, which passage opening has a first lateral edge, a second lateral edge and a top edge, the device comprising: a first blowing device with a first primary blower slit, suitable for being arranged at the first lateral edge of the passage opening in such a way that a first substantially planar air stream is blown over substantially the entire height and at least a first part of the width of the passage opening; and a second blowing device with a second primary blower slit, suitable for being arranged at the second lateral edge of the passage opening in such a way that a second substantially planar air stream is blown over substantially the entire height and at least a second part of the width of the passage opening; wherein the device is further provided with regulating means for regulating the respective blowing speeds of the first blowing device and the second blowing device; and wherein the first blowing device and the second blowing device are provided with secondary blower slits which are parallel to the respective primary blower slits, which secondary blower slits are connected to secondary means for drying and/or heating air to be blown.

Although the invention may be used for all types of atmospheric separation, the invention is particularly useful if the first space and the second space have a mutually different temperature and/or humidity. The invention will be described below in relation to this type of situation, without any intention to limit the scope of application of the invention thereto.

According to current technical knowledge, it is not desirable for an air wall to be blown from both sides of a passage opening to be screened, since this would counteract the effects of the layered air stream and a column of mist (condensation and/or formation of ice) would form around the centre of the passage, whether as a result of the collision of the opposing air streams or of the presence of an unscreened area between the two air streams.

The present invention is based, inter alia, on the inventor's inventive insight that screening is indeed possible by means of an air wall which is blown from two sides if means are provided which are able to adequately prevent the expected negative effects.

The invention therefore provides regulating means which can be used to regulate the blowing speed of the respective blowing devices in such a way that the first air stream and the second air stream cover the width of the passage opening, and that the occurrence of turbulence is minimized in the area where the first air stream and the second air stream meet. The regulating means, which may comprise valves, grids, and the like, must be adjustable in a sufficiently precise manner to allow the fitter or operator to regulate the air flow rates (or speeds) for a certain passage opening in such a way that the respective air walls just touch one another, without however colliding with one another with such an amount of energy that considerable turbulence would be generated.

Experiments conducted by the inventor have unexpectedly shown that such an equilibrium is indeed achievable and is sufficiently stable, and that a very efficient screening of the passage opening is possible in this way.

The physical properties of the blown air are dependent on the location of the air suction (on the colder/drier side or on the warmer/more humid side of the passage opening) and on the additional conditioning which is used (in particular relating to temperature and/or humidity).

Although the planar air streams generated by the primary blower slits will naturally entrain secondary air streams, it is advantageous in the case of extreme differences in condition between the first and the second space to use an actively generated secondary air stream for the separation. The temperature and/or humidity of the air in the secondary air stream is selected on the basis of the respective air conditions in the first and the second space. The Mollier diagram may be used to select an operation point that serves to prevent the formation of mist at the respective interfaces between the first space and the primary air stream, between the primary air stream and the secondary air stream, and between the secondary air stream and the second space. If the primary air stream is also actively conditioned, two degrees of freedom are available for finding a transition path from the conditions of the first space to the conditions of the second space, without crossing the saturation area. Where necessary, reference is made here to FIG. 6A of the previously cited application WO 2009/051482 A1 and the associated description, which are incorporated for this purpose by way of reference.

The invention has the advantage that it is possible to achieve surprisingly effective screening with a relatively low consumption of energy. In many cases it is enough, in any case, to condition the constrained secondary air stream in order to achieve the desired screening. Since this secondary air stream may represent a much smaller flow rate than the primary air stream, a smaller amount of energy is needed to dry and/or heat this secondary air stream to the required operation point than if the primary air stream were to be conditioned for this purpose.

In an embodiment of the device according to the present invention, the first blowing device and the second blowing device are provided with primary blower slits having a width in the range of 10-40 mm and a length in the blowing direction of 5-40 cm, preferably 10-30 cm. More particularly preferred values for the width of the primary blower slits of the first blowing device and the second blowing device include a width of approximately 12.5 mm (e.g., between 11 mm and 14 mm), or widths in the range of 14-25 mm.

It has been found that blower slits having these dimensions are very suitable for generating a rigid air wall, in particular at air speeds from 10 m/s, preferably from 16 m/s, and even more preferably from 25 m/s.

In an embodiment of the device according to the present invention, the first blowing device and the second blowing device are additionally connected to primary means for drying and/or heating air to be blown through the primary blower slits.

The temperature and/or humidity of the air in the primary air stream is also selected on the basis of the respective air conditions in the first and the second space, in coordination with the selection of the temperature and/or humidity in the secondary air stream.

In an embodiment of the device according to the present invention, the first blowing device and the second blowing device are constructed from vertically adjoining modules, and the regulating means are designed to regulate a blowing speed for each module.

It is an advantage of this embodiment that it is possible to take into account the different behaviour of the air at different heights in a suitable manner. For example, in the area close to the ground, the heavier cold air in the colder space will tend to migrate into the warmer space, while in the higher layers of air the lighter warm air will be drawn from the warmer space into the colder space. In an intermediate area, the two effects cancel one another out, and less power is required to separate the respective volumes of air from one another.

In an embodiment of the device according to the present invention, the first blowing device and the second blowing device are designed to vary the blowing direction over the height of the passage opening.

It is an advantage of this embodiment that it is possible to take into account the different behaviour of the air at different heights in a suitable manner. For example, it is useful, for the reasons mentioned above, to direct the air wall slightly towards the colder space close to the ground, and to direct it slightly towards the warmer space at a greater height.

In an embodiment, the device according to the present invention is further provided with a bridging element which extends from an end of the first blowing device to a corresponding end of the second blowing device, wherein the bridging element is suitable for being arranged at the top edge of the passage opening in such a way that a third substantially planar air stream is blown over substantially the entire width and at least part of the height of the passage opening.

In this embodiment, a gantry is formed which blows air into the passage opening from three sides. In this way, the screening capacity of the device can be even further improved.

According to an aspect of the present invention, a method is provided for screening a passage opening between a first space and a second space by means of an air wall, which passage opening has a first lateral edge, a second lateral edge and a top edge, the method comprising: generating a first substantially planar air stream over substantially the entire height and a first part of the width of the passage opening by means of a first blowing device with a first primary blower slit, arranged at the first lateral edge of the passage opening; generating a second substantially planar air stream over substantially the entire height and a second part of the width of the passage opening by means of a second blowing device with a second primary blower slit, arranged at the second lateral edge of the passage opening; and generating respective secondary air streams by means of secondary blower slits which are provided in the first blowing device and the second blowing device and are parallel to the respective primary blower slits, wherein the air to be blown through the secondary blower slits is dried and/or heated; wherein the respective blowing speeds of the first blowing device and the second blowing device are regulated by regulating means in such a way that the first air stream and the second air stream cover the width of the passage opening, and that the occurrence of turbulence is minimized in an area where the first air stream and the second air stream meet.

In an embodiment of the method according to the present invention, the first blowing device and the second blowing device are provided with primary blower slits having a width in the range of 10-40 mm and a length in the blowing direction of 5-40 cm, preferably 10-30 cm. More particularly preferred values for the width of the primary blower slits of the first blowing device and the second blowing device include a width of approximately 12.5 mm (e.g., between 11 mm and 14 mm), or widths in the range of 14-25 mm.

In an embodiment, the method according to the present invention comprises the drying and/or heating of the air to be blown in by the first blowing device and the second blowing device through the primary blower slits.

In an embodiment of the method according to the present invention, the first blowing device and the second blowing device are constructed from vertically adjoining modules, wherein the blowing speed of each module is regulated.

In an embodiment of the method according to the present invention, the blowing direction varies over the height of the passage opening.

In an embodiment, the method according to the present invention comprises generating a third substantially planar air stream over substantially the entire width and at least part of the height of the passage opening by means of a bridging element which is arranged at the top edge of the passage opening and extends from an end of the first blowing device to a corresponding end of the second blowing device.

In an embodiment of the method according to the present invention, the first space and the second space have a mutually different temperature and/or humidity.

The technical effects and advantages of the embodiments of the method according to the present invention correspond, mutatis mutandis, to those of the corresponding embodiments of the device according to the present invention.

EP 1 342 959 A1 discloses a device comprising at least two core air jet nozzles arranged in different edge regions of an opening and connected to an air blower. The outlet openings of the core air jet nozzles are directed in the direction of the opening so that the core air jets produced by the core air jet nozzles are directed through the opening into the refuse depot from different directions at an angle of 1-60 degrees. Two core air jet nozzles may be arranged on opposite-lying or adjacent sides of the opening. EP 1 342 959 A1 does not deal with separating spaces with significantly different temperature and/or humidity, and it does not disclose the use of secondary blower slits, parallel to the primary blower slits, to generate a heated and/or dried secondary air stream.

U.S. Pat. No. 3,350,994; GB 968,358; and US 2004/0242146 A1 disclose various portal-type air curtain devices.

These and other technical effects and advantages of the invention will now be explained in more detail on the basis of the attached drawings, in which.

Figure 1:
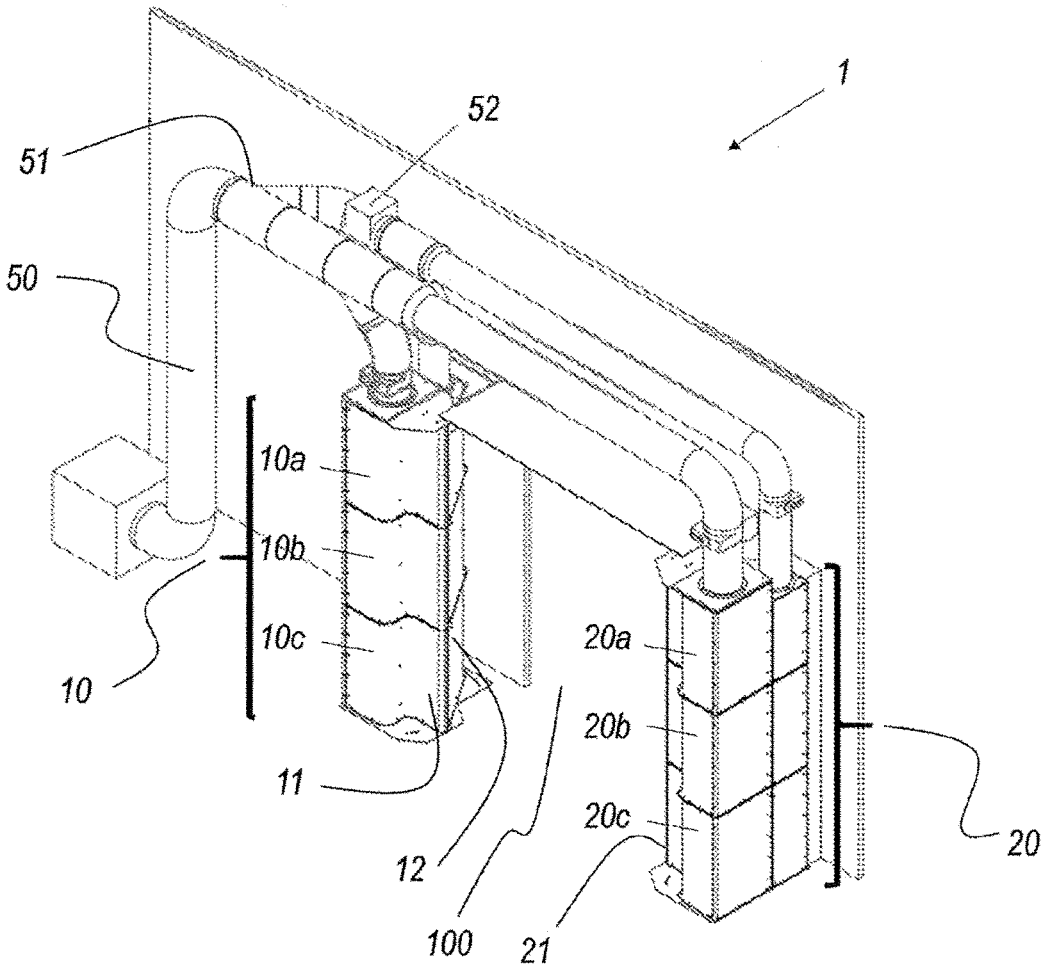
FIG. 1 is an outline drawing of a device according to an embodiment of the present invention.

The general construction of a device 1 according to an embodiment of the present invention is represented in FIG. 1. The device is formed by a pair of vertical blowing devices or blowing columns 10, 20 on either side of the passage 100 to be screened, connected to a common air supply system 50. Without any loss of generality, a device is illustrated without a horizontal blower prism which generates an additional air layer from above. The placement of such a prism will nevertheless be immediately clear to a person skilled in the art.

Both the primary air stream and the secondary air stream are actively generated by the device. For this purpose the air supply system 50 comprises a branching 51 which divides the supplied pressure between a primary channel and a secondary channel. The primary channel opens out in each of the blowing columns 10, 20 in the chamber which is connected to the primary blower slit 11, 21, with the secondary channel opening out in each of the blowing columns 10, 20 in the chamber which is connected to the secondary blower slit 12, 22. In the illustrated embodiment, a conditioning unit 52 is provided only in the secondary channel, for heating and/or drying the air in the secondary air wall. In this way, it is possible to provide an effective air wall between spaces with very different atmospheres in an energy-efficient manner. Embodiments are also possible in which the primary air stream is also conditioned.

In the illustrated arrangement, each of the two blowing columns 10, 20 is constructed from three modules 10*a-c*, 20*a-c*. The number of modules has been selected purely by way of example; the person skilled in the art will understand that a greater or smaller number of modules may be selected depending on the requirements of the specific situation, or that it is even possible to use columns which consist of one piece. Apart from the necessary connection elements, the respective modules of a column preferably have a substantially identical form.

Figure 2:
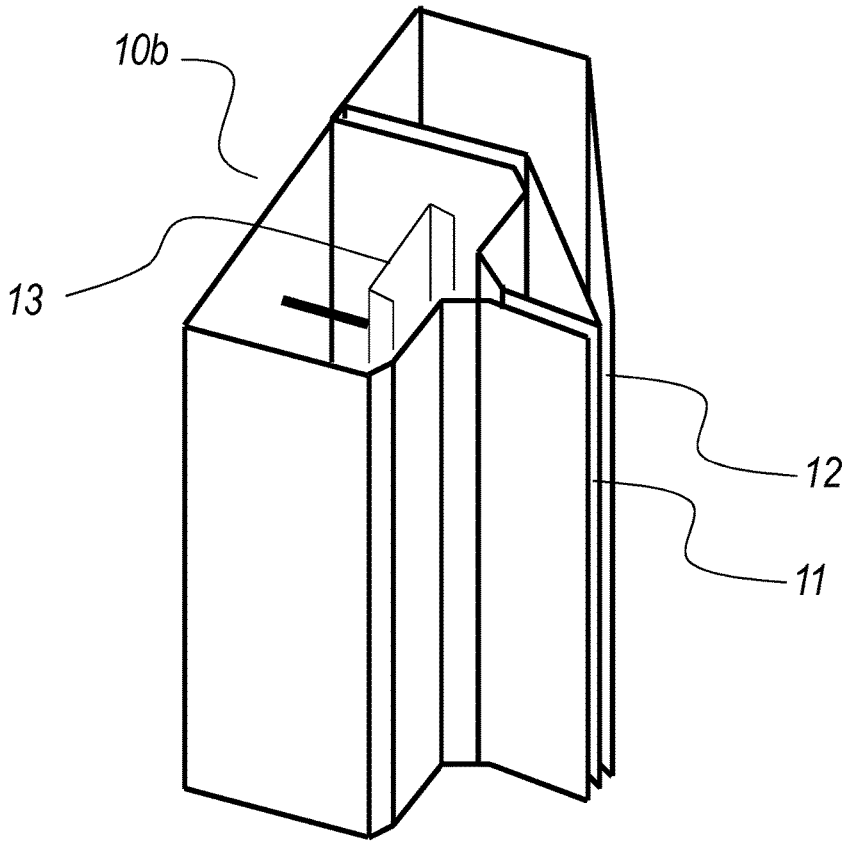
FIG. 2 is a detail drawing of a module for constructing a device according to an embodiment of the present invention.
Figure 3:
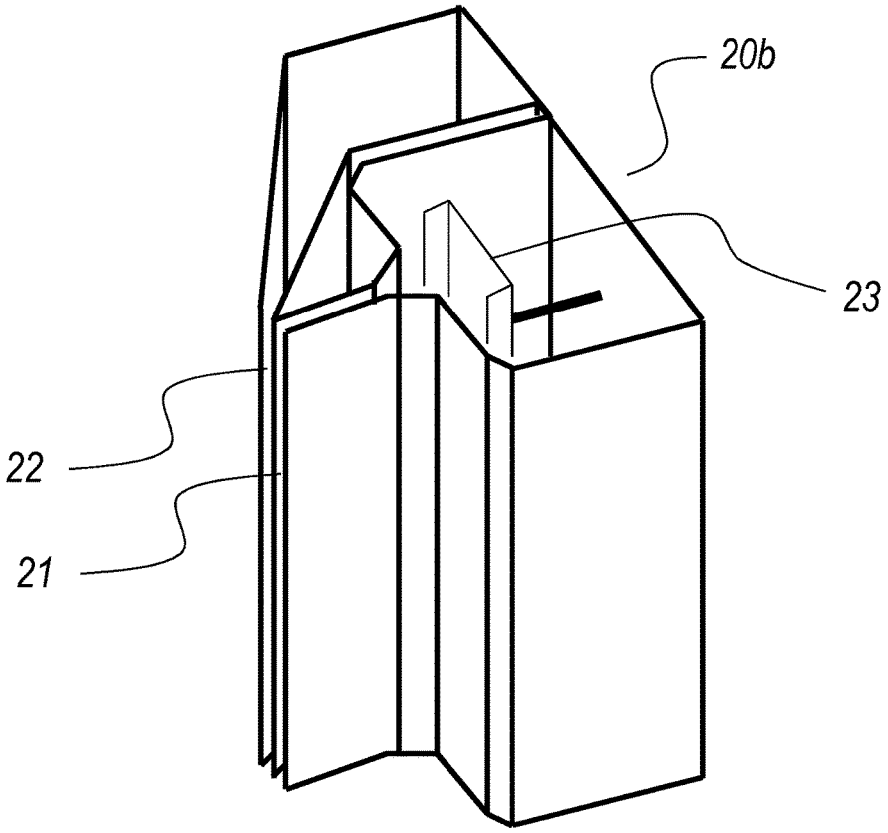
FIG. 3 is a detail drawing of a module for constructing a device according to an embodiment of the present invention, suitable for use on the opposite side of a passage opening relative to the module of FIG. 2.

FIG. 2 illustrates a possible embodiment of a module for use in the device according to the present invention, module 10*b* being used as an example. FIG. 2 illustrates a functionally identical module 20*b* arranged for use on the opposite side of the passage opening. For the sake of clarity, the end plates are not shown; said end plates contain the connection elements which are needed to be able to stack the modules on top of one another and to guarantee the supply of air to the primary and secondary chambers.

The primary chamber, i.e. the chamber which is connected to the primary blower slit 11, 21, contains regulating means 13, 23 to regulate the flow rate of the primary air stream. In the illustrated embodiment, the regulating means comprise a plate which can be moved to a greater or smaller distance from the funnel-shaped inlet of the blower slit by means of a bolt or threaded rod, as a result of which (for a specific pressure of the supplied air) respectively a greater or smaller air flow rate through the primary blower slit is set.

In the illustrated embodiment, there are no regulating means in the secondary chamber, i.e. the chamber which is connected to the secondary blower slit 12, 22, since the regulating means are merely optional here.

By providing the regulating means at the level of the individual modules 10*a-c*, 20*a-c*, it is possible to vary the flow rate of the planar air streams along the vertical axis. It is thus possible to counteract air flows in the direction transverse to the plane of the passage opening 100 in an optimum manner.

For further details about the possible construction of the blowing devices reference is explicitly made to WO 2009/051482 A1 and WO 2010/085861 A2, both in the name of the applicant.

Although the invention has been described above on the basis of specific embodiments, these serve merely for clarification and do not constitute a limitation of the invention, the scope of which is defined by the attached claims.

The invention claimed is:

1. Device (1) for generating an air wall across a passage opening between a first space and a second space, wherein the first space and the second space have a mutually different temperature and/or humidity, which passage opening (100) has a first lateral edge, a second lateral edge and a top edge, the device (1) comprising:

a first blowing device (10) with a first primary blower slit (11), arranged at the first lateral edge of the passage opening (100) in such a way that a first substantially planar air stream is blown over substantially the entire height and at least a first part of the width of the passage opening (100); and a second blowing device (20) with a second primary blower slit (21), arranged at the second lateral edge of the passage opening (100) in such a way that a second substantially planar air stream is blown over substantially the entire height and at least a second part of the width of the passage opening (100);

wherein the device (1) is further provided with regulating means (13;23) for regulating the respective blowing speeds of the first blowing device and the second blowing device; and wherein the first blowing device (10) and the second blowing device (20) are provided with secondary blower slits (12; 22) which are parallel to the respective primary blower slits (11; 21), which secondary blower slits (12; 22) are connected to secondary means for drying and/or heating air to be blown.

2. Device (1) according to claim 1, wherein the primary blower slits (11; 21) have a width in the range of 10-40 mm and a length in the blowing direction of 5-40 cm.

3. Device (1) according to claim 1 or claim 2, wherein the first blowing device (10) and the second blowing device (20) are constructed from vertically adjoining modules (10*a*, 10*b*, 10*c*; 20*a*, 20*b*, 20*c*), wherein the regulating means (13; 23) are designed to regulate a blowing speed for each module.

4. Device (1) according to claim 3, wherein the first blowing device (10) and the second blowing device (20) are designed to vary the blowing direction over the height of the passage opening (100).

5. Device (1) according to claim 3, further provided with a bridging element which extends from an end of the first blowing device (10) to a corresponding end of the second blowing device (20), wherein the bridging element is arranged at the top edge of the passage opening (100) in such a way that a third substantially planar air stream is blown over substantially the entire width and at least part of the height of the passage opening (100).

6. Method for screening a passage opening (100) between a first space and a second space by means of an air wall, wherein the first space and the second space have a mutually different temperature and/or humidity, which passage opening (100) has a first lateral edge, a second lateral edge and a top edge, the method comprising:

generating a first substantially planar air stream over substantially the entire height and a first part of the width of the passage opening (100) by means of a first blowing device (10) with a first primary blower slit (11), arranged at the first lateral edge of the passage opening (100); and generating a second substantially planar air stream over substantially the entire height and a second part of the width of the passage opening (100) by means of a second blowing device (20) with a second primary blower slit (21), arranged at the second lateral edge of the passage opening (100); and generating respective secondary air streams by means of secondary blower slits (12; 22) which are provided in the first blowing device (10) and the second blowing device (20) are parallel to the respective primary blower slits (11; 21), wherein the air to be blown through the secondary blower slits (12; 22) is dried and/or heated; wherein the first blowing device (10) and the second blowing device (20) provide respective blowing speeds, which are regulated by regulating means (13; 23) in such a way that the first air stream and the second air stream cover the width of the passage opening (100), and that the occurrence of turbulence is minimized in an area where the first air stream and the second air stream meet.

7. Method according to claim 6, wherein the primary blower slits (11; 21) have a width in the range of 10-40 mm and a length in the blowing direction of 5-40 cm.

8. Method according to claim 6 or claim 7, wherein the first blowing device (10) and the second blowing device (20) are constructed from vertically adjoining modules (10*a*, 10*b*, 10*c*; 20*a*, 20*b*, 20*c*), and wherein the blowing speed of each module is regulated.

9. Method according to claim 8, wherein the blowing direction varies over the height of the passage opening (100).

10. Method according to claim 8, further comprising generating a third substantially planar air stream over substantially the entire width and at least part of the height of the passage opening (100) by means of a bridging element which is arranged at the top edge of the passage opening (100) and extends from an end of the first blowing device (10) to a corresponding end of the second blowing device (20).

11. Device (1) according to claim 1, wherein the primary blower slits (11; 21) have a width in the range of 10-40 mm and a length in the blowing direction of 10-30 cm.

12. Method according to claim 6, wherein the primary blower slits (11; 21) have a width in the range of 10-40 mm and a length in the blowing direction of 10-30 cm.

* * * * *